United States Patent [19]

Tibbetts

[11] 4,410,769

[45] Oct. 18, 1983

[54] TRANSDUCER WITH ADJUSTABLE ARMATURE YOKE AND METHOD OF ADJUSTMENT

[75] Inventor: George C. Tibbetts, Camden, Me.

[73] Assignee: Tibbetts Industries, Inc., Camden, Mass.

[21] Appl. No.: 328,857

[22] Filed: Dec. 9, 1981

[51] Int. Cl.[3] ..... H04R 11/00

[52] U.S. Cl. ..... 179/119 A; 179/114 A; 179/104; 179/117; 310/25

[58] Field of Search ..... 179/117, 111 A, 119 A, 179/104; 310/25; 340/384 E, 384 R

[56] References Cited

U.S. PATENT DOCUMENTS

| | | | |
|---|---|---|---|
| 3,013,127 | 12/1961 | Christensen et al. | 179/114 |
| 3,185,779 | 5/1965 | Sawyer | 179/114 |
| 3,230,426 | 1/1966 | Sawyer et al. | 317/173 |
| 3,531,745 | 9/1970 | Tibbets | 335/231 |
| 3,560,667 | 2/1971 | Carlson | 179/114 |
| 3,588,383 | 6/1971 | Carlson et al. | 179/119 A |
| 3,671,684 | 6/1972 | Tibbets et al. | 179/117 |
| 3,935,398 | 1/1976 | Carlson et al. | 179/114 A |
| 4,272,654 | 6/1981 | Carlson | 179/119 A |

*Primary Examiner*—G. Z. Rubinson
*Assistant Examiner*—Robert Lev
*Attorney, Agent, or Firm*—Kenway & Jenney

[57] ABSTRACT

An electromechanical magnetic transducer with a moving armature that is adjustable relative to the working gap. The armature comprises an armature leg, crosspiece, and yoke arms, the adjustment being accomplished by inelastic distortion of the yoke arms. Substantially translational movement of the intrinsic position of the armature leg during adjustment is achieved by providing in each yoke arm one or more struts that undergo S-shaped distortion upon application of adjusting forces in appropriate directions. The structures are further adaptable for rotational adjustments of the armature leg in the gap.

24 Claims, 9 Drawing Figures

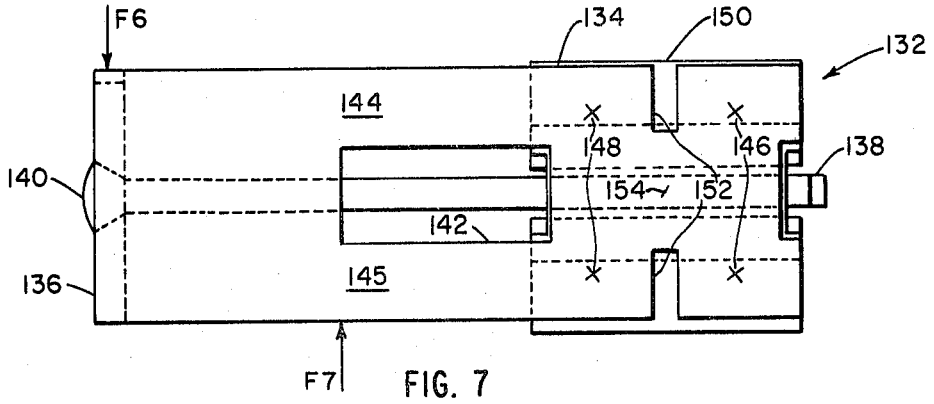
FIG. 7
FIG. 8
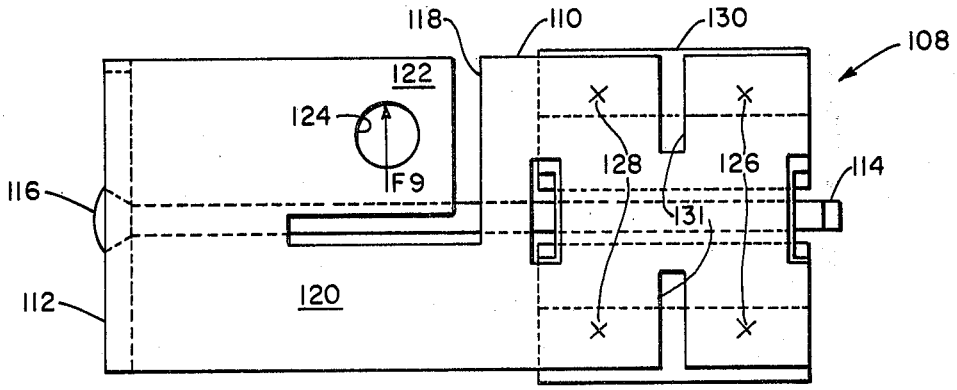
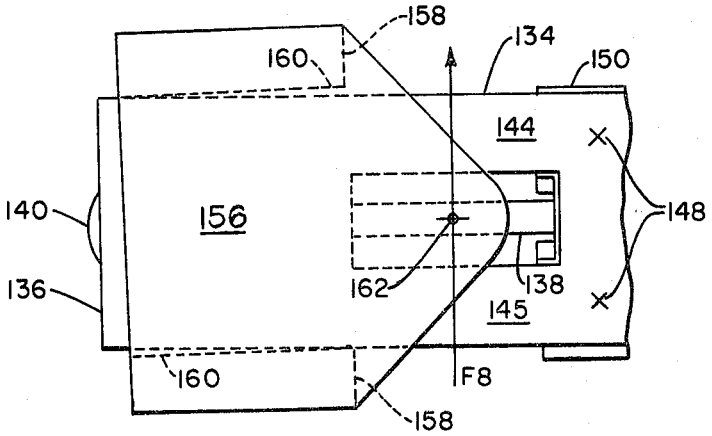
FIG. 7a

TRANSDUCER WITH ADJUSTABLE ARMATURE YOKE AND METHOD OF ADJUSTMENT

BRIEF SUMMARY OF THE INVENTION

This invention relates generally to electromechanical transducers, and more particularly to transducers having armatures that vibrate in a working gap between magnetic poles. The poles establish a polarizing magnetic field. Signal flux is established between the poles and the armature, passing through the armature from the working gap through an electrical coil. Typical transducers of this type are described in U.S. Pat. No. 3,617,653, issued Nov. 2, 1971 to Tibbetts et al, U.S. Pat. No. 3,671,684, issued June 20, 1972 to Tibbetts et al, and U.S. Pat. No. 3,935,398, issued Jan. 27, 1976 to Carlson et al.

The above patents describe armatures having an armature leg that is generally flat and extends through the electrical coil into the working gap, and an armature yoke having a crosspiece that is integral with or connects to the end of the armature leg remote from the working gap and that extends laterally of the principal dimension of the armature leg, the armature yoke having yoke arm means extending from the lateral extremity of the crosspiece back toward the polarizing flux means and the working gap.

For proper operation, the surfaces of the armature leg within the working gap should be substantially parallel to the opposed pole faces and the armature leg should be effectively centered in the working gap. In practice, it is desirable to provide a means for making a permanent adjustment in the armature leg position after the assembly has been completed. As described in U.S. Pat. No. 3,617,653, the permanent magnets are magnetized after assembly of the parts, and the adjustments of the armature leg are made after such magnetization by twisting inelastically the crosspiece of the armature yoke. This twisting is accomplished in regions of the crosspiece that straddle the attachment to the armature leg. While this method of adjustment provided a notable improvement in the mechanical shock resistance over earlier transducers, there are certain disadvantages, as follows.

One such disadvantage of inelastically adjusting the crosspiece resides in the internal stresses that persist after displacing portions of the crosspiece material from their original stress-relieved, annealed locations. These stresses caused by the twisting of the crosspiece reduce its strength; therefore, the thickness and other dimensions of the crosspiece relative to those of the armature leg are chosen to compensate for the damage. However, notwithstanding this form of compensation for loss of strength, the twisting adjustment inevitably causes the strength of the damaged, adjusted crosspiece to be much greater in one direction of twist than in the other. In addition the persistent internal stresses introduce a source of creep in the state of adjustment. Therefore, under certain conditions the adjusted transducer may lack stability with respect to the position of the armature leg in the gap.

Adjustment by twisting of the crosspiece has a further limitation with respect to the resulting relocation of the armature leg within the gap. For example, the twisting of the crosspiece pivots the armature leg about an axis which lies in the crosspiece. In the case where the armature leg does not require adjustment with respect to its parallelness to the pole faces but only lacks proper centering in the gap, the twisting of the crosspiece to improve the centering also destroys the accuracy of the parallelism to a greater or lesser extent. In that case, the adjustment is essentially a compromise involving the achievement of better centering with a sacrifice in the parallelism of the armature leg to the pole faces. In certain embodiments, for example receivers in hearing aids and the like, this compromise reduces the power handling capability, increases the harmonic distortion, and increases the sensitivity of this distortion to bias current changes.

With a view to overcoming the above limitations and disadvantages of adjustment by inelastic twisting of the crosspiece, the features of the present invention include an armature of novel structure that may be adjusted without damaging the crosspiece by plastic deformation. More specifically, the novel armature structure is provided with yoke arms that may be plastically deformed to provide the needed adjustment.

As hereinafter more fully described, the adjustment of the yoke arms may be accomplished, according to this invention, without creating significant instability due to creep. Moreover, a different mode of adjustment is provided, that is, it is now possible to adjust the armature leg by a substantially rectilinear translational movement normal to its plane, as contrasted to the rotational movement caused by twisting the crosspiece in prior art structures. Accordingly, adjustments of a more nearly optimum nature can be performed with resulting improved transducer performance and stability.

DESCRIPTION OF THE DRAWING

FIG. 7 is a side elevation illustrating a second alternative embodiment of the armature structure.

FIG. 7*a* shows a detail of FIG. 7 with an adjusting jaw in place.

FIG. 8 is a side elevation illustrating a third alternative embodiment of the armature structure.

DETAILED DESCRIPTION

Figure 1:
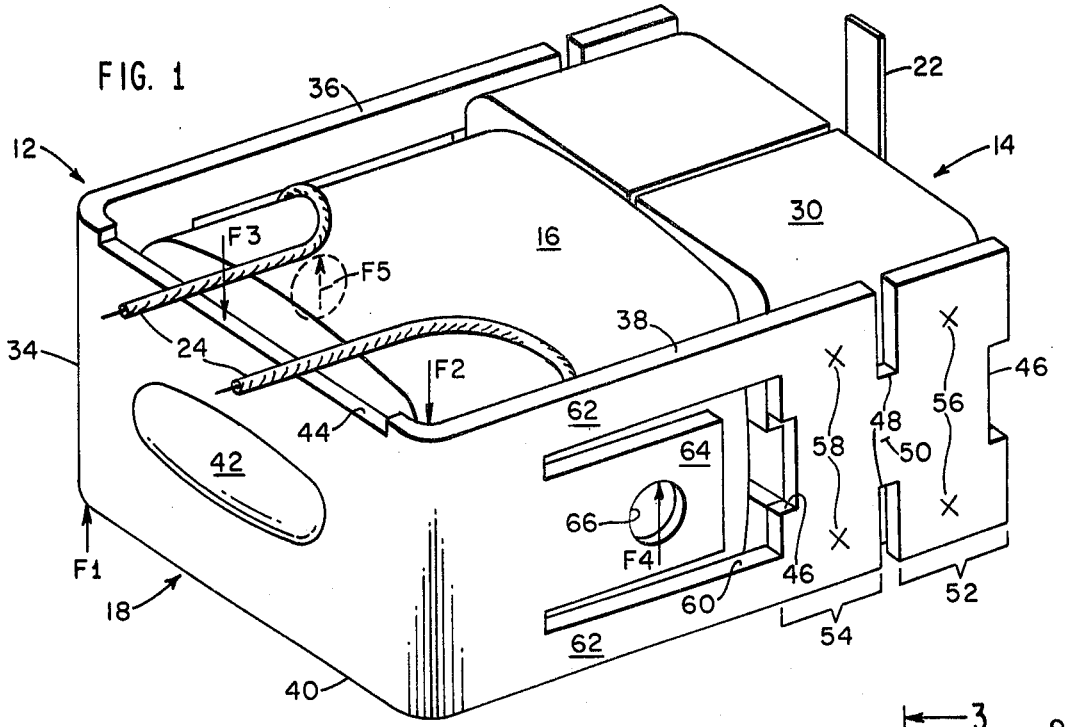
FIG. 1 is a perspective view of a fully assembled electromechanical transducer according to this invention.
Figure 2:
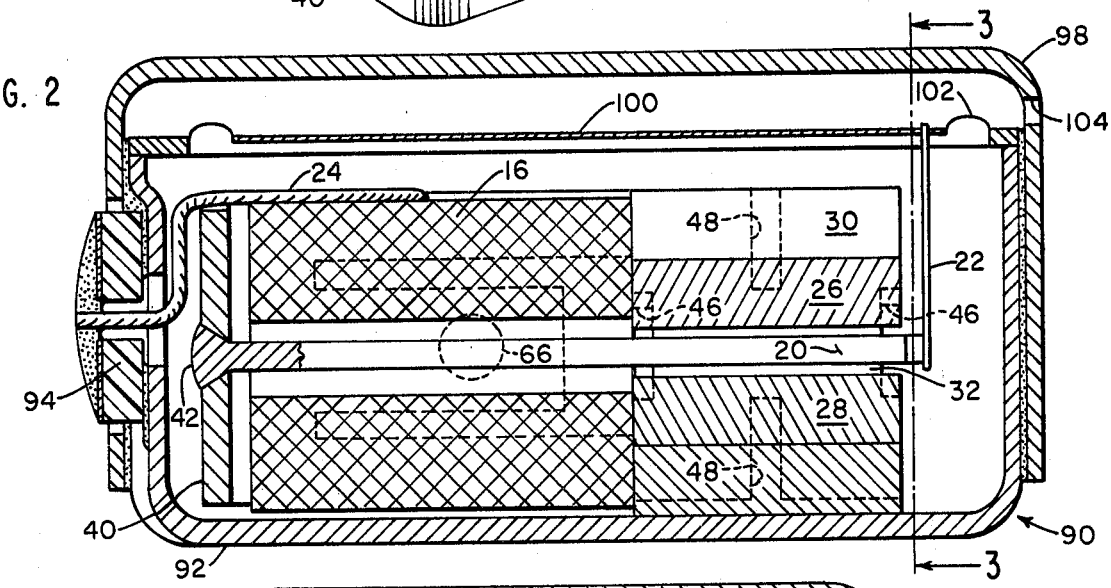
FIG. 2 is an elevation in section showing the transducer of FIG. 1 assembled, after adjustment, in a case to provide an electroacoustic transducer.
Figure 3:
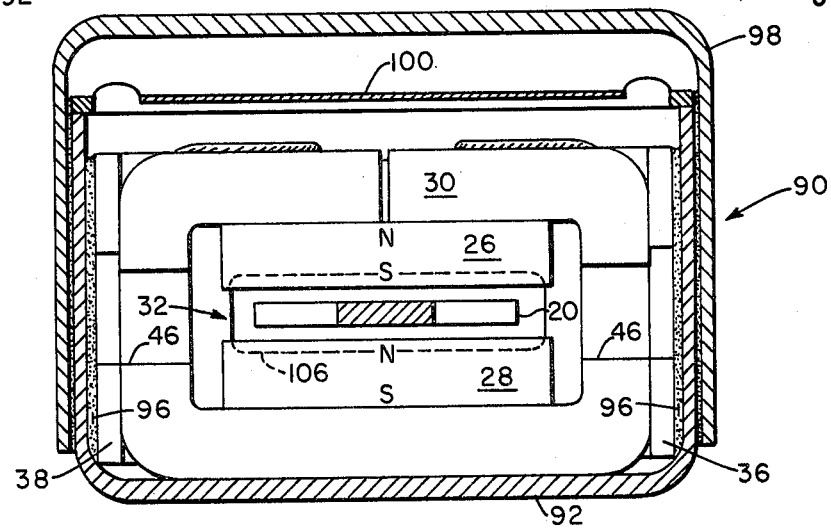
FIG. 3 is an elevation in section taken on line 3—3 of FIG. 2.

Referring to the drawings, FIG. 1 shows an electromechanical transducer designated generally at 12, comprising polarizing flux means 14, an electrical coil 16, and armature means 18. The armature means includes an armature leg 20, the otherwise free end of which is attached to a pin 22. In a receiver embodiment as illustrated in FIGS. 2 and 3, an electrical signal current through the coil leads 24 causes the armature leg and the attached pin 22 to deflect.

The polarizing flux means 14 consists of a pair of permanent magnets 26 and 28 and a magnet strap 30 of high permeability magnetic material in the form of a flat strip folded into a substantially rectangular, closed configuration. The magnets 26 and 28 are secured to the strap 30 and have substantially flat, mutually parallel opposed surfaces forming a working gap 32.

The armature means 18 is also formed of high permeability magnetic material and comprises the armature leg 20 and an armature yoke 34. The armature yoke is formed from a flat sheet and folded to define a pair of yoke arms 36 and 38 joined by an integral crosspiece 40. The armature leg 20 is formed from a flat sheet and is elongate and of generally rectangular shape. An end of the armature leg is attached to the crosspiece 40 by a high strength, stable weld 42, for example a laser weld. The coil 16 surrounds the armature leg and fits within the space provided between the crosspiece 40 and the magnet strap 30, and is secured initially to the magnet strap 30. A notch 44 in the crosspiece enables the leads 24 of the coil to be brought out without adding to the overall height of the transducer.

Sighting slots 46 are formed in the magnet strap 30 and the ends of the yoke arms to permit observation of the position of portions of the armature leg in the working gap.

In the embodiment of FIGS. 1 to 3, each of the yoke arms has a pair of notches 48 forming a necked region 50. These necked regions connect between end portions 52 and end portions 54 of the yoke arms. The end portions 52 and 54 fit closely against the magnet strap 30, and end portions 52 are attached to it by a pair of resistance welds 56. The fully assembled transducer, as shown in FIG. 1, also has a pair of resistance welds 58 that attach the end portions 54 of the yoke arms to the magnet strap 30.

Each of the yoke arms contains a slot 60 having elongate portions that define a pair of elongate substantially prismatic struts 62 extending in directions parallel to the principal dimension of the armature leg 20. Between the struts 62 there is an adjusting tab 64 having an aperture 66. The aperture 66 is substantially centered on the lengthwise extent of the struts 62.

The transducer is assembled by putting the parts together as shown in FIG. 1 without the resistance welds 56 and 58. Then, while the tip of the armature leg 20 is approximately in the correct position in the gap 32, the welds 56 are made. Following this, successive steps are performed as next described.

First, initial rotational adjustments are performed by applying vertical forces such as F3 or the couple F1 and F2, as shown in FIG. 1, to the edges of the crosspiece 40, causing the necked regions 50 to deform plastically, effectively functioning as hinges. By observing the tip of the armature leg through the sighting slots 46, the tip may be adjusted to be substantially parallel with the magnets. Thus, if the plane of the armature leg is initially such that it is spaced substantially the same from the magnet 26 on the side adjacent the yoke arm 36 as it is on the side adjacent the yoke arm 38, the force F3 can be applied and the adjustment will be substantially rotational about an axis passing through the necked regions 50 in a direction normal to the yoke arms. On the other hand, the couple F1 and F2 can be applied to achieve any needed rotation of the armature leg about an axis parallel to its principal dimension, as required to achieve parallelism of the tip of the armature leg to the opposed magnet surfaces. During these adjustments, preferably no plastic deformation of the struts 62 occurs, and this is satisfied by providing slots 48 that are deep enough to narrow the regions 50 so that the plastic deformation will occur in these regions. Upon the completion of this adjusting step, the welds 58 are made, thereby protecting the necked regions 50 from further deformation in the subsequent steps.

The next step consists in magnetizing the magnets 26 and 28 by exposing the entire transducer 12 to an external source of a strong magnetic field (not shown). Similar means may be used subsequently to demagnetize the fully magnetized magnets to the desired operating point.

As a result of the magnetized state of the magnets, the position of the tip of the armature leg in the working gap becomes a function not only of the intrinsic position of the armature leg, that is, the position that the armature leg would assume if the magnets were not magnetized, but also of any magnetic forces that may act on the tip. When the tip of the armature leg is approximately in mid position between the magnet pole faces the magnetic forces acting on it are virtually nil, and they increase as the tip moves away from the this position. The purpose of the subsequent adjustments, described below, is to locate the tip of the armature leg at or near the mid position where the best operating characteristics can be achieved, taking into account all influencing facotrs such as DC bias current, magnet tolerances, hysteresis, and the like. Therefore, when such subsequent adjustments have been achieved the armature leg will be located substantially in its intrinsic position. In any case, such subsequent adjustments are assumed in the following discussion to refer to the intrinsic position.

After the magnetization step, the magnet strap 30 is held in a suitable fixture, and adjusting pins of the fixture (not shown) are inserted freely into each of the apertures 66. A second, substantially translational, adjustment is next made by the application of vertical forces, that is, forces in the directions of arrows F4 and F5 as shown in FIG. 1, through the adjusting pins to each of the tabs 64 and thence to each of the pairs of struts 62, causing the armature leg to be adjusted in the gap essentially by vertical translation. In this way the initial degree of parallelism of the armature leg in the gap is substantially preserved while effectively centering the armature leg between the pole faces. In transducers required to carry a DC bias current, such centering may be effective magnetic centering rather than mechanical centering.

If desired, the second adjustment may consist not only of the essentially translational displacement of the armature leg described above, which is produced when substantially equal forces F4 and F5 are applied to each of the yoke arms 36 and 38, but also of an additional rotational displacement which is produced when sufficiently unequal forces F4 and F5 are applied to the yoke arms. This rotational displacement will be about an axis parallel to the principal dimension of the armature leg.

Figure 4:
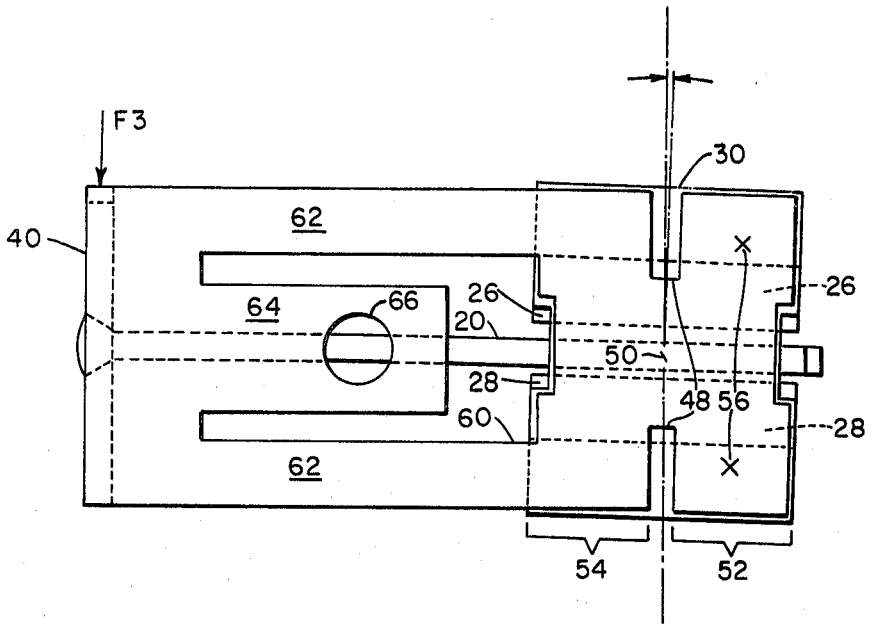
FIG. 4 is a side elevation of the armature and polarizing field structure of FIG. 1, illustrating a preliminary, rotational adjustment step.
Figure 5:
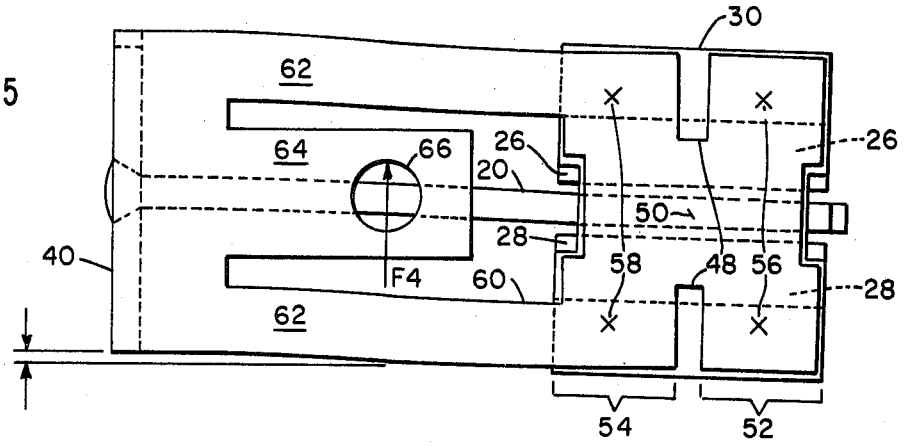
FIG. 5 is an elevation similar to FIG. 4 illustrating a second, substantially translational adjustment step.

FIGS. 4 and 5 illustrate one example of the separate steps of adjustment described above. The first or rotational adjustment for achieving parallelism is illustrated by FIG. 4. In this figure, a force F3 has been applied to the crosspiece 40 to deform the region 50 plastically to achieve parallelism of the armature leg 20 with respect to the faces of the magnets 26 and 28. After this, the welds 58 are made as previously described and as shown in FIG. 5. After magnetization, the magnet strap 30 is held and forces F4 and F5 are applied to the tabs 64 for centering the armature leg in the gap. The resulting edgewise elastic-plastic bending of each of the struts 62 deforms them in an S-shaped curvature as shown. As a result, the armature leg 20 undergoes substantially pure translation with respect to the fixed ends of the yoke arms. There are three principal conditions that give rise to this result: (1) the regions of the yoke arm joining the adjacent ends of a pair of struts are rigid, (2) the adjusting force such as F4 is centered on the lengthwise extent of the struts 62, and (3) the cross section of the struts is symmetric about the midpoint lengthwise of each strut, while the yield strength of the yoke arm material is homogeneous over the struts. With the first condition in view, the dimensions of the yoke arms are selected so that there are adequate dimensions spacing the crosspiece 40 and the notches 48, respectively, from the nearest portions of the slots 60. The second condition is approximately satisfied, as stated above, by locating the apertures 66 substantially centrally of the longitudinal extent of the struts 62. The third condition may be partially addressed by fabricating the struts 62 to have nominally constant cross section. In practical applications, where these conditions cannot be satisfied exactly by the means described, it is useful to provide in combination the pair of spaced struts 62, with each strut slender compared to the overall height of the yoke arm, thereby aiding the attainment of a small, generally negligible rotation component during the second adjustment. Furthermore, even when conditions (1), (2) and (3) are not well satisfied, the pair of spaced struts provides considerable resistance to rotation during the second adjustment. This will be further discussed below in relation to FIG. 7.

When the above conditions (1), (2) and (3) hold exactly, the net tensile-compressive force within each strut is zero. In practice, for example when the adjusting force F4 is only approximately centered, the net tensile-compressive force is small, and there is negligible tendency for a strut to undergo column type buckling.

While the structure employing a pair of spaced struts is preferred, useful results are provided by a single strut structure in combination with an adjusting force which is approximately centered on the lengthwise extent of the strut. This is illustrated in FIG. 8. This figure shows armature means 108 comprising a pair of yoke arms 110, a crosspiece 112 integral with and extending between the yoke arms, and an armature leg 114 attached to the armature yoke by a weld 116 similar to the weld 42. In this embodiment there is provided an L-shaped slot 118 defining a single strut 120 and an adjusting tab 122. An aperture 124 in the tab is substantially centered on the lengthwise extent of the strut 120. Welds 126 correspond to the welds 56 and welds 128 correspond to the welds 58, and are used for attachment of the yoke arms to a magnet strap 130. A pair of notches 131 perform the same function as the notches 48. The steps of assembly and adjustment of this embodiment are performed the same as the steps described above for the embodiment of FIGS. 1 to 5. With the adjusting force F9 essentially centered on the lengthwise extent of the strut 120, the curvature function of the elastic-plastic beam represented by the deformed strut is substantially an odd function of lengthwise position along the strut about its midpoint. Consequently, the slope of the deflection function is substantially the same at the respective ends of the strut, and correspondingly the adjustment of the armature leg is substantially translational without rotation.

The embodiment of the armature shown in FIGS. 1 to 5 is preferred in those cases where the armature yoke 34 has adequate height, that is, an adequate vertical dimension as viewed in FIGS. 4 and 5. This will permit the formation of a sufficiently strong adjusting tab 64 while at the same time providing struts 62 of appropriate dimensions. The dimensions required for the struts are determined not only by mechanical requirements but also by their magnetic flux carrying capability. Thus, it is desirable that the total flux carrying capability of the four struts shall be at least equal to that of the armature leg. In those situations where the yoke height is insufficient to satisfy these requirements, the embodiment of FIG. 6 may be used. This figure shows armature means 68 comprising yoke arms 70, a crosspiece 72 integral with the yoke arms, and an armature leg 74 attached to the armature yoke by a weld 76 similar to the weld 42. In this embodiment there is provided a substantially rectangular slot 78 defining struts 80. The dimensions of the slot 78 are selected to satisfy the above mentioned mechanical and flux-carrying requirements for the struts 80, without reference to the provision of an adjusting tab. An adjusting plate 82 having an aperture 84 is attached to the yoke arm as by resistance welds 86. The plate 82 may be formed at 88 to space the plate slightly from the faces of the struts 80. The aperture 84 is approximately centered on the lengthwise extent of the struts 80.

Figure 6:
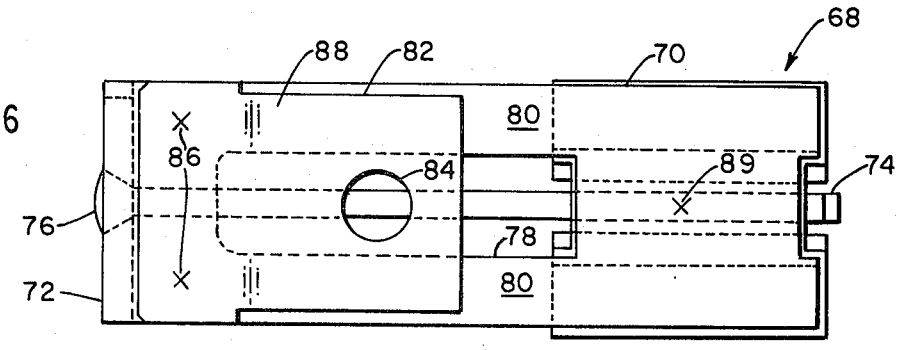
FIG. 6 is a side elevation illustrating a first alternative embodiment of the armature structure.

FIG. 6 illustrates a further variation of the embodiment of FIG. 1 in which the necked regions 50 are omitted. A single weld 89 centered on each yoke arm connects it to the magnet strap. The initial, rotational adjustment is accomplished by twisting this weld, after which subsequent welds (not shown) complete the assembly of the armature yoke to the magnet strap.

The embodiment of FIG. 6 is useful when limited height is available, but it does require the adjusting plates 82, which add appreciably to the overall width of the transducer.

In those situations in which there is insufficient room for the adjusting plates, they may be omitted as illustrated in FIG. 7. This figure shows armature means 132 comprising yoke arms 134, a crosspiece 136 integral with the yoke arms, and an armature leg 138 attached to the armature yoke by a weld 140 similar to the weld 42. A substantially rectangular slot 142 defines struts 144 and 145. The dimensions of the slot are selected to satisfy the above mentioned flux-carrying requirements for the struts, while, as shown, the struts may be shortened to provide greater unslotted length in the yoke arm adjacent the crosspiece 136. Welds 146 correspond to the welds 56 and welds 148 correspond to the welds 58, and are used for attachment of the yoke arms to a magnet strap 150. A pair of notches 152 perform the same function as the notches 48. The steps of assembly and adjustment of this embodiment are the same as the steps described above for the embodiment of FIGS. 1 to 5 except for the point or points of application of the adjusting force or forces during the second adjustment. Thus, during the first, rotational adjustment which occurs after the welds 146 have been made and before the welds 148 have been made, a force F6, or a couple corresponding to the couple F1 and F2 as shown in FIG. 1, is applied to the edges of the crosspiece 136, causing necked regions 154 to deform plastically, adjusting the tip of the armature to be substantially parallel with the magnets. As illustrated in FIG. 7, the second adjustment may be made, after the welds 148 have been completed, by applying a force F7 to the edge of the yoke arm near the ends of the struts which are adjacent the crosspiece 136. The force F7 causes elastic-plastic bending of the struts 144 and 145, deforming them in a generally S-shaped curvature similar to that shown in FIG. 5. The force F7 also causes, when applied in the direction shown in FIG. 7, a slight shortening of the strut 144 and a slight lengthening of strut 145. Corresponding to this shortening and lengthening of the respective struts, there is a rotation of the crosspiece 136, and attached armature leg 138, relative to the magnet strap 150. It has been found empirically, however, that this rotational component is surprisingly small compared with the translational component of the adjustment, with the result that a useful quasi-translational second adjustment can be obtained by means of a force such as F7.

In those situations where a more accurately translational adjustment is required, the armature of FIG. 7 may be adjusted analogously to the armature of FIG. 5 or FIG. 6 by the means illustrated in FIG. *7a*. This figure is a detail of FIG. 7, and shows an adjusting jaw 156 having bosses 158, with the inner edges 160 of the bosses temporarily engaging, with clearance, the facing edges of the yoke arm 134. The two adjusting jaws, which engage the pair of yoke arms, are permanent components of an adjusting fixture, and are mounted on bearings aligned along the axis 162 normal to the plane of the drawing, the bearings allowing the jaws to pivot about this axis. The adjusting forces F8 are applied through the bearings of the fixture to the respective adjusting jaws 156. If the axis 162 is approximately centered on the lengthwise extent of the struts 144 and 145, the adjustment of the armature leg 138 that results from the forces F8 is substantially translational.

It is clear from the foregoing discussion that the variations on the structure of FIG. 5, illustrated by FIG. 6 and FIG. *7a*, are applicable to single strut armatures such as that of FIG. 8.

In the fabrication of armature means according to this invention, the pieces respectively forming the armature leg and armature yoke are first formed as shown and welded together. Alternatively, the armature leg may be formed integrally with the armature yoke as described in the above-cited patents. In either case, the completely formed armature means 18 is then subjected to a high temperature annealing process. This relieves the internal stresses caused by the previous steps of fabrication and develops the magnetic properties to useful levels. The armature means is then assembled with the coil 16 and polarizing flux means 14. The further steps of assembly and adjustment described above are then carried out. The adjustments are such that neither the armature leg nor the crosspiece is deformed plastically after annealing. Consequently, neither the creep behavior nor the shock resistance of these portions of the armature is adversely affected by the steps of adjustment. Although these steps do produce elastic-plastic deformation in the struts, the creep effects due to persistent stresses in these parts are negligible. This is because the struts resist further deformation, as would be caused by any relaxation of internal stresses, by edgewise bending, and have a length considerably less than that of the armature leg. Thus, the stiffness of the pair of yoke arms as measured at the pin 22 is typically several hundred times greater than that of the remainder of the armature as represented by flexure in the armature leg and torsion of the crosspiece. Further, the strength of the adjusted struts in any embodiment of practical dimensions is greater than that of a crosspiece adjusted by inelastic twisting according to the prior art.

Further advantages of this invention may be appreciated from a consideration of FIGS. 2 and 3 illustrating the assembly of the transducer 12 with other parts forming an electroacoustic transducer designated generally at 90. The transducer 12 is mounted in a cup-like casing 92 of substantial strength, which is provided with a terminal board 94 to receive the coil leads 24. Substantially the entire space between the yoke arms 36 and 38 and the casing is filled with a bonding material 96 which is a strong, high stiffness adhesive such as epoxy adhesive. In this way the strength of the yoke arms 36 and 38 is further enhanced.

In the prior art it has not been practical to strengthen an adjusted armature by adhesive bonding to another structure. The adhesives that are available and potentially applicable, such as epoxy adhesives, creep readily under sustained stress, and swell and shrink in response to the humidity of the ambient atmosphere. Such effects also occur in the bonding material 96, but the net effect on the operating characteristics of the transducer 12 is negligible as a result of the very high stiffness of the yoke arms compared with the rest of the armature. Because of the transient nature of the force pulses that are characteristic of mechanical shock, however, the bonding material 96, suitably chosen, is effective in reinforcing the adjusted struts 62 against such shock.

The casing 92 may be partially enclosed by another cup-like casing 98 which slips over and is adhesively bonded to it. This provides a box-like enclosure with double side walls, all fabricated from a high permeability magnetic material. The large overlap area of the side walls of the respective cups provides a low reluctance joint between the cups, and thus minimizes the leakage of magnetic fields generated by the transducer 12 into the surrounding environment. In such structures the outside cup further reinforces the bonded strut-casing structure against mechanical shock.

In the embodiment of FIGS. 2 and 3, there is provided a diaphragm 100 which is supported at its periphery by the surround 102 and at one end by a flexural pivot (not shown), and which at its other end connects with the armature leg 20 by means of the pin 22 (FIG. 2). Means for acoustical communication with the space between the diaphragm 100 and the casing 98 are of conventional form, and include the slot 104 in the casing 98. In FIG. 3, the longitudinal aperture of the coil 16 is shown at 106.

I claim:

1. An electromechanical transducer having, in combination, polarizing flux means comprising at least one permanent magnet and a pair of spaced, facing pole surfaces defining a working gap, an electrical coil, and armature means comprising an elongate, flux conductive armature leg extending through the coil into the gap, a flux conductive crosspiece fixed to the armature leg remote from the gap and extending laterally from the armature leg, and an elongate, flux conductive yoke arm fixed to the crosspiece and extending in the general direction of the armature leg, the lengthwise dimension of the yoke arm comprising first and second sections, the first section being secured to the polarizing flux means and the second section comprising a plurality of mutually spaced plastically deformable struts that extend along a substantial portion of the yoke arm.

2. The combination of claim 1, in which the transducer has an adjusting tab attached to the armature means adjacent the junction of the yoke arm and the crosspiece and extending along at least a portion of each of the struts.

3. The combination of claim 2, in which the second section has at least one closed slot to define a pair of spaced struts, and the adjusting tab extends between and in spaced relation to the struts.

4. The combination of claim 3, in which the struts are coextensive in length and the adjusting tab has a perforation located substantially midway of the length of the struts.

5. The combination of claim 1, in which each strut has a substantially constant cross section and the struts are mutually parallel.

6. An electromechanical transducer having, in combination, polarizing flux means comprising at least one permanent magnet and a pair of spaced, facing pole surfaces defining a working gap, an electrical coil, and armature means comprising an elongate, flux conductive armature leg extending through the coil into the gap, a flux conductive crosspiece fixed to the armature leg remote from the gap and extending laterally from the armature leg, and an elongate, flux conductive yoke arm fixed to the crosspiece and extending in the general direction of the armature leg, the lengthwise dimension of the yoke arm comprising first and second sections, the first section being secured to the polarizing flux means and the second section comprising a plastically deformable strut that extends along a substantial portion of the yoke arm, said transducer further including an adjusting tab attached to the armature means adjacent the junction of the yoke arm and the crosspiece, and extending along at least a portion of the length of the strut.

7. The combination of claim 6, in which the adjusting tab has a perforation in a location which projects upon the lengthwise extent of the strut.

8. The combination of claim 6, in which the second section has a slot extending along the yoke arm to form a strut of substantially reduced cross section, the slot further extending laterally of the yoke arm to an edge thereof.

9. The combination of claim 8, in which the adjusting tab is integral with the yoke arm, is defined by the slot, and has a perforation located substantially midway of the length of the strut.

10. The combination of either of claim 2 or claim 6, in which the adjusting tab has provision to locate an adjusting tool for application of a lateral force substantially midway of the length of at least one strut.

11. The combination of either of claim 2 or claim 6, in which the yoke arm is substantially flat and the adjusting tab is integral with the yoke arm.

12. The combination of either of claim 2 or claim 6, in which the adjusting tab overlaps the yoke arm, including a strut portion, and is attached by welding to the yoke arm.

13. The combination of either of claim 1 or claim 6, in which the first section is apertured to provide visibility of portions of the armature leg within the working gap.

14. The combination of either of claim 1 or claim 6, in which the crosspiece is substantially flat and perpendicular to the direction of the armature leg.

15. The combination of either of claim 1 or claim 6, in which the yoke arm is fabricated from one piece.

16. The combination of either of claim 1 or claim 6, in which the crosspiece and yoke arm components of the armature means are integral where fixed together.

17. The combination of claim 16, in which the armature leg and crosspiece components of the armature means are integral where fixed together.

18. The combination of either of claim 1 or claim 6, in which the crosspiece extends laterally from the armature leg in opposite directions, with substantially identical yoke arms fixed to each end of the crosspiece.

19. The combination of claim 18, with a cup-like casing, said yoke arms being adjacent and bonded to inner surfaces of the side walls of said casing.

20. The combination of claim 18, with a pair of cup-like casings of high permeability magnetic material, said casings enclosing said transducer and having a substantial portion of their respective side walls bonded together in overlying relationship, the yoke arms being bonded to inner surfaces of the side walls of the innermost of said casings.

21. The combination of either of claim 1 or claim 6, in which said first section is subdivided by a structurally weakened portion of the first section.

22. The combination of claim 21, in which one subdivision of the first section has a first attachment to the polarizing flux means located to permit rotation of the second section by plastic deformation of said structurally weakened portion, and a second subdivision of the first section has a second attachment to the polarizing flux means located to prevent plastic deformation of said structurally weakened portion upon the application of a force to the second section remotely from the first section.

23. The combination of claim 22, in which the first section is slotted transversely of the yoke arm.

24. The combination of either of claim 3 or claim 8, in which the slot is spaced a substantial distance from the crosspiece.

* * * * *